US010196826B1

(12) United States Patent
Rosan

(10) Patent No.: US 10,196,826 B1
(45) Date of Patent: Feb. 5, 2019

(54) ELEVATED FLOORING SYSTEM

(71) Applicant: EverBlock Systems, LLC, New York, NY (US)

(72) Inventor: Arnon Rosan, New York, NY (US)

(73) Assignee: EverBlock Systems, LLC, New York City, NY (US)

( * ) Notice: Subject to any disclaimer, the term of this patent is extended or adjusted under 35 U.S.C. 154(b) by 0 days.

(21) Appl. No.: 15/954,391

(22) Filed: Apr. 16, 2018

(51) Int. Cl.
*E04F 15/024* (2006.01)
*E04H 3/28* (2006.01)
*E04F 15/10* (2006.01)

(52) U.S. Cl.
CPC .. *E04F 15/02452* (2013.01); *E04F 15/02417* (2013.01); *E04H 3/28* (2013.01); *E04F 15/102* (2013.01); *E04F 15/105* (2013.01); *E04F 2201/0138* (2013.01);
(Continued)

(58) Field of Classification Search
CPC ..... E04F 15/024; E04F 15/02411; E04F 2015/02116; E04F 2015/02055; E04F 2015/02127; E04F 15/02494; E04F 15/02452; H02G 3/385; H02G 3/285; E04H 3/28
See application file for complete search history.

(56) References Cited

U.S. PATENT DOCUMENTS

D879,455 2/1908 Frost
968,512 A 8/1910 Praray
1,689,107 A 10/1928 Bradley
(Continued)

FOREIGN PATENT DOCUMENTS

DE 3445071 A1 11/1987
DE 20209502 U 10/2002
(Continued)

OTHER PUBLICATIONS

MegaDeck Photos—Protective Maiting and Temporary Roadway Gallery (online). dated Sep. 26, 2011. Retrieved from Internet Apr. 4, 2017. URL: https://web.archive.org/web/20110926113010/http:www.megadeckrigmats.com/megadeck-gallery.php (3 pages).
(Continued)

*Primary Examiner* — Gisele D Ford
(74) *Attorney, Agent, or Firm* — Metz Lewis Brodman Must O'Keefe LLC

(57) ABSTRACT

An elevated flooring system includes floor modules each having first and second module surfaces and module ribs. First module surfaces may be solid or include holes for drainage. Module ribs provide structural support and define at least one module receiving space accessible from the second module surface. Block(s) include extensions protruding from a first block surface and are dimensioned to fit within a corresponding module receiving space. Each block includes block ribs providing support and defining at least one block receiving space accessible from a second block surface. Interfacing member(s) include a body correspondingly dimensioned to fit within a block receiving space and leg(s) extending from the body and dimensioned to fit within a hole on a first module surface. Floor modules may be joined adjacently and interfacing members, blocks and floor modules are stackable to provide a modular and customizable flooring system of different and varying heights.

20 Claims, 8 Drawing Sheets

(52) U.S. Cl.
CPC ... *E04F 2201/0517* (2013.01); *E04F 2290/00* (2013.01); *E04F 2290/02* (2013.01)

(56) References Cited

U.S. PATENT DOCUMENTS 1,977,496 A 10/1934 Snyder et al.
D148,930 S 3/1948 Hickman
3,005,282 A 10/1961 Christiansen
D194,083 S 11/1962 Brach
3,162,973 A 12/1964 Godtfred
3,310,919 A 3/1967 Bue et al.
3,349,533 A 10/1967 Gregoire
3,382,632 A 5/1968 Grofcsik
3,397,496 A 6/1968 Sohns
D215,582 S 10/1969 Bogan
3,487,756 A 1/1970 Glaza et al.
3,859,000 A 1/1975 Zeif
3,964,221 A 6/1976 Berquist
D243,855 S 3/1977 Hynes
4,026,086 A 5/1977 Langley
4,067,155 A 1/1978 Ruff et al.
4,198,795 A 4/1980 Barnidge
4,238,181 A 12/1980 Dannels
4,254,574 A 3/1981 Stock
4,436,779 A 3/1984 Menconi et al.
4,468,910 A 9/1984 Morrison
4,629,358 A 12/1986 Springston et al.
4,630,417 A * 12/1986 Collier ..... F24F 7/10 174/487
4,840,825 A 6/1989 Aristodimou
D304,042 S 10/1989 Poulson
4,883,503 A * 11/1989 Fish ..... E04F 15/02447 52/263
4,901,485 A 2/1990 Menchetti et al.
4,988,131 A 1/1991 Wilson et al.
D317,482 S 6/1991 Michaelsen
5,022,200 A 6/1991 Wilson et al.
5,061,218 A 10/1991 Garage
5,070,662 A 12/1991 Niese
D326,874 S 6/1992 Dideriksen
D331,696 S 12/1992 Graham
5,263,289 A * 11/1993 Boyd ..... H02G 3/285 52/220.2
5,295,341 A 3/1994 Kajiwara
5,364,204 A 11/1994 MacLeod
5,400,554 A * 3/1995 Lo ..... E04F 15/02411 52/126.2
5,402,609 A 4/1995 Kelley
5,403,063 A 4/1995 Sjostedt et al.
5,407,342 A 4/1995 Boucher et al.
5,427,558 A 6/1995 Knudsen et al.
5,434,355 A * 7/1995 Sho ..... H02G 3/28 174/487
5,469,999 A 11/1995 Phirippidis
D368,939 S 4/1996 Fredericksen
5,509,244 A 4/1996 Bentzon
D376,281 S 12/1996 Robertson
D378,837 S 4/1997 Olsen
5,630,300 A * 5/1997 Chen ..... E04F 15/02411 174/488
5,630,304 A 5/1997 Austin
5,653,551 A 8/1997 Seaux
5,657,598 A 8/1997 Wilbs et al.
5,666,772 A 9/1997 Betty
D387,431 S 12/1997 Tremblay
D391,110 S 2/1998 Graebe
5,777,266 A 7/1998 Herman et al.
5,787,654 A 8/1998 Drost
5,833,386 A 11/1998 Rosan et al.
5,865,007 A 2/1999 Bowman
D409,676 S 5/1999 Toft
5,904,015 A * 5/1999 Chen ..... E04F 15/02494 52/220.2
5,950,378 A 9/1999 Council
D415,471 S 10/1999 Henry
5,966,889 A 10/1999 Zinner
D416,143 S 11/1999 Ragan
5,987,840 A 11/1999 Leppert
5,992,106 A 11/1999 Carling et al.
6,032,428 A * 3/2000 Rosan ..... E01C 5/20 52/177
D426,933 S 6/2000 Redfern
6,093,469 A 7/2000 Callas
6,094,882 A 8/2000 Pervan
6,098,354 A 8/2000 Skandis
6,128,881 A 10/2000 Bue et al.
D437,832 S 2/2001 Henry
6,187,394 B1 2/2001 Johnson et al.
6,189,283 B1 2/2001 Bentley et al.
6,200,187 B1 3/2001 Olsen et al.
6,202,565 B1 3/2001 Henry
6,220,785 B1 4/2001 Kennedy et al.
6,245,415 B1 6/2001 Keller et al.
D445,148 S 7/2001 McIntosh
6,282,858 B1 9/2001 Swick
6,293,062 B1 * 9/2001 Chen ..... E04F 15/02429 52/126.5
D449,170 S 10/2001 Kim
6,330,770 B1 * 12/2001 Fukunaga ..... E04F 15/02447 174/482
D456,533 S 4/2002 Moller
D457,971 S 5/2002 Schrader
6,434,897 B1 8/2002 Sievers et al.
6,455,127 B1 9/2002 Valtanen
D463,866 S 10/2002 Jang
6,481,036 B1 11/2002 Duvall
6,499,410 B1 12/2002 Berardi
D468,839 S 1/2003 Bland
6,511,257 B1 1/2003 Seaux et al.
6,550,192 B1 4/2003 Nelson et al.
6,554,604 B1 4/2003 Schmidt
6,564,522 B1 5/2003 Chiu-Ying
6,584,739 B2 7/2003 Zeif
6,649,110 B1 11/2003 Seaux et al.
6,662,508 B1 12/2003 Else
6,684,582 B2 2/2004 Peart et al.
6,685,388 B2 2/2004 Webster et al.
6,695,527 B2 2/2004 Seaux et al.
6,719,551 B2 4/2004 Polk, Jr.
6,747,212 B1 6/2004 Henry
6,751,912 B2 6/2004 Stegner et al.
D498,307 S 11/2004 Zimmerle
6,869,558 B2 3/2005 Polk, Jr.
6,878,881 B1 4/2005 Henry
6,900,547 B2 5/2005 Polk, Jr.
6,909,373 B2 6/2005 Power et al.
D515,223 S 2/2006 Geffe
7,080,491 B1 7/2006 Shreiner et al.
7,145,079 B1 12/2006 Henry
7,208,219 B2 4/2007 Polk, Jr.
D552,190 S 10/2007 Glickman
7,299,592 B2 11/2007 Moller
7,303,800 B2 12/2007 Rogers
7,309,836 B2 12/2007 Lubanski
7,332,672 B2 2/2008 Henry
D563,323 S 3/2008 Henry
7,340,865 B2 3/2008 Vanderhoef
7,360,343 B1 * 4/2008 Spransy ..... E04F 15/02452 52/263
7,385,139 B2 6/2008 Lubanski
7,401,441 B2 7/2008 Zimmerle
7,413,374 B2 8/2008 Rogers et al.
D581,553 S 11/2008 Cooper
D583,771 S 12/2008 Lubanski
7,487,622 B2 2/2009 Wang
7,516,587 B2 4/2009 Barlow
7,531,746 B2 5/2009 Henry
7,546,707 B1 6/2009 Digennaro
7,571,573 B2 8/2009 Moller
7,592,547 B2 9/2009 Lubanski
7,607,265 B2 10/2009 Curry et al.
7,621,092 B2 11/2009 Groeke et al.
7,674,980 B2 3/2010 Lubanski
7,779,595 B2 8/2010 Polk, Jr.

(56) References Cited

U.S. PATENT DOCUMENTS

| | | | | |
|---|---|---|---|---|
| 7,795,535 | B2 | 9/2010 | Lubanski | |
| 7,827,750 | B2 | 11/2010 | Sondermann | |
| 7,837,917 | B2 | 11/2010 | Polk, Jr. | |
| 7,838,772 | B2 | 11/2010 | Lubanski | |
| 7,842,226 | B2 | 11/2010 | Polk, Jr. | |
| 7,914,228 | B2 | 3/2011 | Rapaz | |
| 7,923,095 | B2 | 4/2011 | Polk, Jr. | |
| 7,931,845 | B2 | 4/2011 | Polk, Jr. | |
| 7,939,759 | B2 | 5/2011 | Henry | |
| 7,943,851 | B2 | 5/2011 | Lubanski | |
| 7,955,550 | B2 | 6/2011 | Polk, Jr. | |
| 7,959,450 | B1 | 6/2011 | Wang et al. | |
| 8,070,471 | B2 | 12/2011 | Polk, Jr. | |
| D652,952 | S | 1/2012 | Angel | |
| 8,119,914 | B2 | 2/2012 | Lubanski | |
| 8,141,314 | B2 | 3/2012 | Rosan | |
| D667,144 | S | 9/2012 | Else | |
| 8,288,652 | B2 | 10/2012 | Lubanski | |
| 8,309,850 | B2 | 11/2012 | Henry | |
| D677,800 | S | 3/2013 | Cetindag | |
| 8,397,466 | B2 | 3/2013 | Jenkins | |
| 8,413,399 | B2 | 4/2013 | Kelley, Jr. | |
| 8,414,217 | B2 | 4/2013 | Rosan | |
| D686,676 | S | 7/2013 | Telford | |
| D689,954 | S | 9/2013 | Rya | |
| D695,534 | S | 12/2013 | Matasovi | |
| D701,973 | S | 4/2014 | Holcomb | |
| 8,756,882 | B1 | 6/2014 | Vachon | |
| 8,791,363 | B2 | 7/2014 | Lubanski | |
| D717,248 | S | 11/2014 | Coffman | |
| D717,379 | S | 11/2014 | Deutsch | |
| D717,971 | S | 11/2014 | Saunders | |
| 8,936,374 | B1 | 1/2015 | Royse | |
| D724,760 | S | 3/2015 | Saunders | |
| D727,884 | S | 4/2015 | Fathollahi | |
| 9,010,060 | B2 | 4/2015 | Rapaz | |
| 9,051,739 | B2 | 6/2015 | Rosan | |
| 9,059,574 | B2 | 6/2015 | Coffman | |
| D738,063 | S | 9/2015 | Angel | |
| 9,187,895 | B2 | 11/2015 | Rodriguez | |
| 9,206,597 | B2 | 12/2015 | Marsh | |
| 9,212,746 | B2 | 12/2015 | McDowell | |
| D746,605 | S | 1/2016 | Matasovic | |
| D748,415 | S | 2/2016 | DeRoeck | |
| D749,680 | S | 2/2016 | Lin | |
| 9,249,570 | B2 | 2/2016 | Jean | |
| D751,153 | S | 3/2016 | Lacroix | |
| D753,774 | S | 4/2016 | Proulx | |
| 9,337,586 | B2 | 5/2016 | McDowell | |
| 9,506,255 | B1 | 11/2016 | Jones | |
| D776,205 | S | 1/2017 | Facey et al. | |
| D783,731 | S * | 4/2017 | Rosan | D21/486 |
| D786,586 | S * | 5/2017 | Rosan | D6/641 |
| 9,673,601 | B2 | 6/2017 | Coffman | |
| D791,885 | S * | 7/2017 | Rosan | D21/500 |
| D800,846 | S * | 10/2017 | Rosan | D21/500 |
| D809,162 | S * | 1/2018 | Rosan | D25/115 |
| 2001/0002523 | A1* | 6/2001 | Chen | E04F 15/02429 52/263 |
| 2002/0059764 | A1 | 5/2002 | Schluter | |
| 2002/0084543 | A1 | 7/2002 | Buja | |
| 2002/0192024 | A1 | 12/2002 | Webster | |
| 2003/0089049 | A1* | 5/2003 | Scissom | E04F 15/02452 52/126.1 |
| 2003/0093964 | A1 | 5/2003 | Bushey et al. | |
| 2003/0113162 | A1 | 6/2003 | Seaux et al. | |
| 2003/0197296 | A1 | 10/2003 | Krassilnikov | |
| 2004/0005430 | A1 | 1/2004 | Rogers | |
| 2004/0093811 | A1 | 5/2004 | Oakey et al. | |
| 2004/0139671 | A1* | 7/2004 | Owen | E04F 15/02452 52/263 |
| 2004/0216250 | A1 | 11/2004 | Dumiao et al. | |
| 2004/0258869 | A1 | 12/2004 | Walker | |
| 2006/0070314 | A1 | 4/2006 | Jenkins et al. | |
| 2006/0130378 | A1 | 6/2006 | Rybalov | |
| 2006/0159793 | A1 | 7/2006 | Hahn et al. | |
| 2006/0265975 | A1 | 11/2006 | Geffe | |
| 2007/0079569 | A1 | 4/2007 | Curry et al. | |
| 2007/0102243 | A1 | 5/2007 | Ruminski | |
| 2007/0108668 | A1 | 5/2007 | Hutchinson et al. | |
| 2007/0113492 | A1 | 5/2007 | Dickey et al. | |
| 2007/0137129 | A1 | 6/2007 | Sondermann | |
| 2007/0261317 | A1 | 11/2007 | Moller, Jr. | |
| 2007/0280782 | A1 | 12/2007 | Rogers | |
| 2008/0127593 | A1 | 6/2008 | Janesky | |
| 2008/0141601 | A1* | 6/2008 | Mead | E04F 15/02452 52/263 |
| 2009/0071083 | A1* | 3/2009 | Huang | E04F 15/02411 52/223.7 |
| 2009/0133349 | A1 | 5/2009 | Sondermann | |
| 2009/0165414 | A1 | 7/2009 | Burk | |
| 2009/0217611 | A1 | 9/2009 | Schrader | |
| 2009/0308002 | A1 | 12/2009 | Curry et al. | |
| 2010/0252788 | A1 | 10/2010 | Wickwire | |
| 2010/0300023 | A1* | 12/2010 | Rosan | E04F 15/105 52/302.1 |
| 2011/0023389 | A1 | 2/2011 | Myers | |
| 2011/0097489 | A1 | 4/2011 | Kerr et al. | |
| 2011/0193253 | A1 | 8/2011 | Polk et al. | |
| 2011/0277926 | A1 | 11/2011 | Polk, Jr. | |
| 2012/0266549 | A1* | 10/2012 | Rosan | E01C 5/20 52/173.1 |
| 2013/0037322 | A1 | 2/2013 | Lubanski | |
| 2013/0319796 | A1* | 12/2013 | Davis | E04G 1/15 182/222 |
| 2014/0020927 | A1 | 1/2014 | Coffman | |
| 2014/0137505 | A1 | 5/2014 | Jean | |
| 2015/0007508 | A1* | 1/2015 | Valtanen | E04B 5/48 52/126.7 |
| 2015/0096250 | A1 | 4/2015 | Lam | |
| 2015/0361675 | A1* | 12/2015 | Cerny | E04B 5/026 52/509 |
| 2016/0017547 | A1 | 1/2016 | Bordelon | |
| 2016/0076204 | A1 | 3/2016 | McDowell | |
| 2016/0301161 | A1 | 10/2016 | McDowell | |
| 2017/0030086 | A1* | 2/2017 | Rodriguez Lopez | E04F 13/0812 |

FOREIGN PATENT DOCUMENTS

| | | | |
|---|---|---|---|
| EP | 1913213 | A1 | 4/2008 |
| EP | 2699729 | B1 | 12/2016 |
| GB | 2256023 | A | 11/1992 |
| GB | 2483412 | B | 10/2015 |
| WO | WO9220885 | A1 | 11/1992 |
| WO | WO2017042734 | | 3/2017 |

OTHER PUBLICATIONS

MegaDeck HD—Rig Mat systems (on-line), dated Jun. 25, 2016. Retrieved from Internet Apr. 4, 2017, URL:https://web.archive.org/web/20160625003824//http://www.megadeckrigmats.com/what-is-megabeck.php (3 pages)

SignaRoad—The Most Versatile Mat on the Market (on-line), dated May 13, 2016. Retrieved from Internet Apr. 4, 2017, URL: https:/web.archive.org/web2016051320056/http:/www.megadeckrigmats.com/SignaRoadphp (3 pages).

Matting/Portable Roadways (on-line), dated Mar. 22, 2013. Retrieved from Internet Apr. 4, 2017, URL: https:/web.archive.org/web/20130322122659/http://coleservicesnj.com/matting_rentals.html (1 page).

Rain for Rent SolidGround Traction Mats (on-line), dated Jan. 30, 2013, Retrieved from Internet Apr. 4, 2017, URL: https:/web.archive.org/web/20130130023451/http:/www.rainforrent.com/SolidGroundTM-Traction-Mats.aspx (1 page).

Lego Classic website, May 31, 2016, (1 page).

Mega Bloks website, May 31, 2016.

I Want That EverBlock: Announced Mar. 9, 2015 [online], site visited May 20, 2016. Available from Internet URL: https://www.youtube.com/watch?v=ac8s71mO8Q0.

(56) References Cited

OTHER PUBLICATIONS

Modular Plastic Blocks: Announced Jun. 18, 2015 [online], site visited May 20, 2017. Available from Internet URL:http//www.everblocksystems.com.

* cited by examiner

ELEVATED FLOORING SYSTEM

FIELD OF THE INVENTION

This invention relates to flooring systems and more particularly, to modular flooring systems having at least one elevated layer and providing variation in both the lateral and vertical dimensions.

BACKGROUND

Events such as concerts, weddings, dances, graduations and parties often require or benefit from temporary flooring. They are often held in places with uneven flooring or flooring that is unsuitable for pedestrian traffic, dancing or other purposes of the event. For instance, many events require a stage, dais, or other type of raised platform where attention may be focused during the event. Such raised platforms are placed on the ground or other floor covering, and are often unstable even when the supporting surface is relatively flat since they are not secured to the ground or floor. Further, these raised platforms are only available in certain predetermined sizes and heights, thereby limiting the amount of elevation that can be achieved with the platform. This likewise limits the creativity and utility of the event space and accommodations. In addition, events may be held on surfaces that are uneven or unstable such as grass, dirt or uneven pavement outdoors that can be hazardous or dirty when walking or dancing, such as from tripping or slipping in mud, loose dirt, uncovered roots, rocks, clots of dirt, etc. Tents may be erected to protect guests from the sun and inclement weather, but they provide only the barest of protections to the ground or floor, and those are at a spaced apart distance. Indoor locations may also have unsuitable flooring, which may be tilted, uneven or unfinished, such as in basements, making navigation problematic unless one is careful.

Modular flooring systems are therefore commonly employed for events to create a temporary, artificial floor that is safer to walk on than the underlying ground or floor. Such modular flooring systems provide stability and can also be used to create a desired aesthetic effect, such as of tiles or borders. They often require the placement and interlocking of individual floor modules to create the overall floor covering, which can then be disassembled and removed when the event is over without damage to the underlying ground or floor. However, these modular flooring systems only cover the floor, and do not address platforms or other raised areas.

Known modular flooring systems also fail to address furniture such as stages, tables, chairs, podiums and other equipment that are supplied separately and placed on the flooring system during the event. Usually the flooring system is smooth to allow for unimpeded locomotion, but this can also mean the furniture may shift on the flooring system during use, which can be dangerous if it occurs during use. Further, any incline in the installed flooring system may lead to sliding of the furniture once placed. This danger is augmented when additional equipment or furniture is layered, such as a podium placed on top of a stage.

Accordingly, there remains room for improvement in the field of modular floor coverings. Specifically, it would be beneficial to have a modular flooring system that is both temporary and customizable to achieve any desired dimension and elevation, while also affording stability.

SUMMARY

An elevated flooring system is disclosed which can be used to cover ground, provide stable floor covering and create elevated portions for further flooring levels of differing heights. The present invention may be used to provide flooring for indoor and outdoor events, within tents, in basements and other areas where the ground or floor may benefit from a more stable surface. The present invention also allows for the creation of a stage, dais, platform(s), walls, stairs, and other elements that may be desired to be located at a distance above the underlying floor or ground. The elevated flooring system is entirely modular so it is fully customizable. The elevated flooring system may be expanded in any direction, including vertically, to create any number of elevated features at any desired height(s). It also permits the formation of multiple layers of flooring, adding versatility and flexibility in design.

The elevated flooring system includes at least one floor module that forms a substantially planar surface of the flooring system. Floor modules may be joined to one another laterally by connecting adjacent floor modules with complimentary connectors projecting from facing sides of the floor modules. Each floor module has a first module surface forming an upper surface upon which people may walk or other components of the system may be stacked, and an opposite second module surface forming an underside of the floor module. The first module surface may be solid or have holes throughout, and may include designs, logos, or other indicia for decoration. The second module surface may be open, revealing a plurality of module ribs that provide structural support and rigidity to the floor module. Module ribs also collectively define module receiving spaces that receive protrusions from other components of the elevated flooring system to enable stacking.

The elevated flooring system also includes at least one block that may be stacked above or below the floor modules to create differences in elevation of the floor modules. Any number of blocks may be stacked on one another, and between floor modules, to create any desired amount of elevation. The blocks include extensions that project from a first block surface. These extensions fit within the module receiving spaces to join the underside or second module surface of a floor module. Each block may include any number of extensions, and the extensions may be any shape. Each block further includes block ribs viewable from an open second block surface opposite the first block surface. Like the module ribs, the block ribs provide structural support to the block and form various block receiving spaces in which to receive protrusions from other components of the elevated flooring system to enable stacking.

The elevated flooring system may also include at least one interfacing member having a body and at least one leg extending therefrom. The body of the interfacing member is shaped and dimensioned to fit within at least one of a block receiving space and a module receiving space. The leg(s) are dimensioned to fit within a hole of the first module surface of a floor module.

Accordingly, the elevated flooring system may be assembled by selectively attaching or joining multiple floor modules to one another along one plane and stacking blocks and/or interfacing members above and/or below. Additional floor modules may be stacked to the blocks and/or interfacing members, forming an elevated layer at a vertical distance from the first layer. The system may be extended in any direction by adding further floor modules, blocks and/or interfacing members. The stacking of various blocks and floor modules locks the matrix together for a stable system.

The elevated flooring system, together with its particular features and advantages, will become more apparent from the following detailed description and with reference to the appended drawings.

DESCRIPTION OF THE DRAWINGS

Like reference numerals refer to like parts throughout the several views of the drawings.

DETAILED DESCRIPTION

Figure 1:
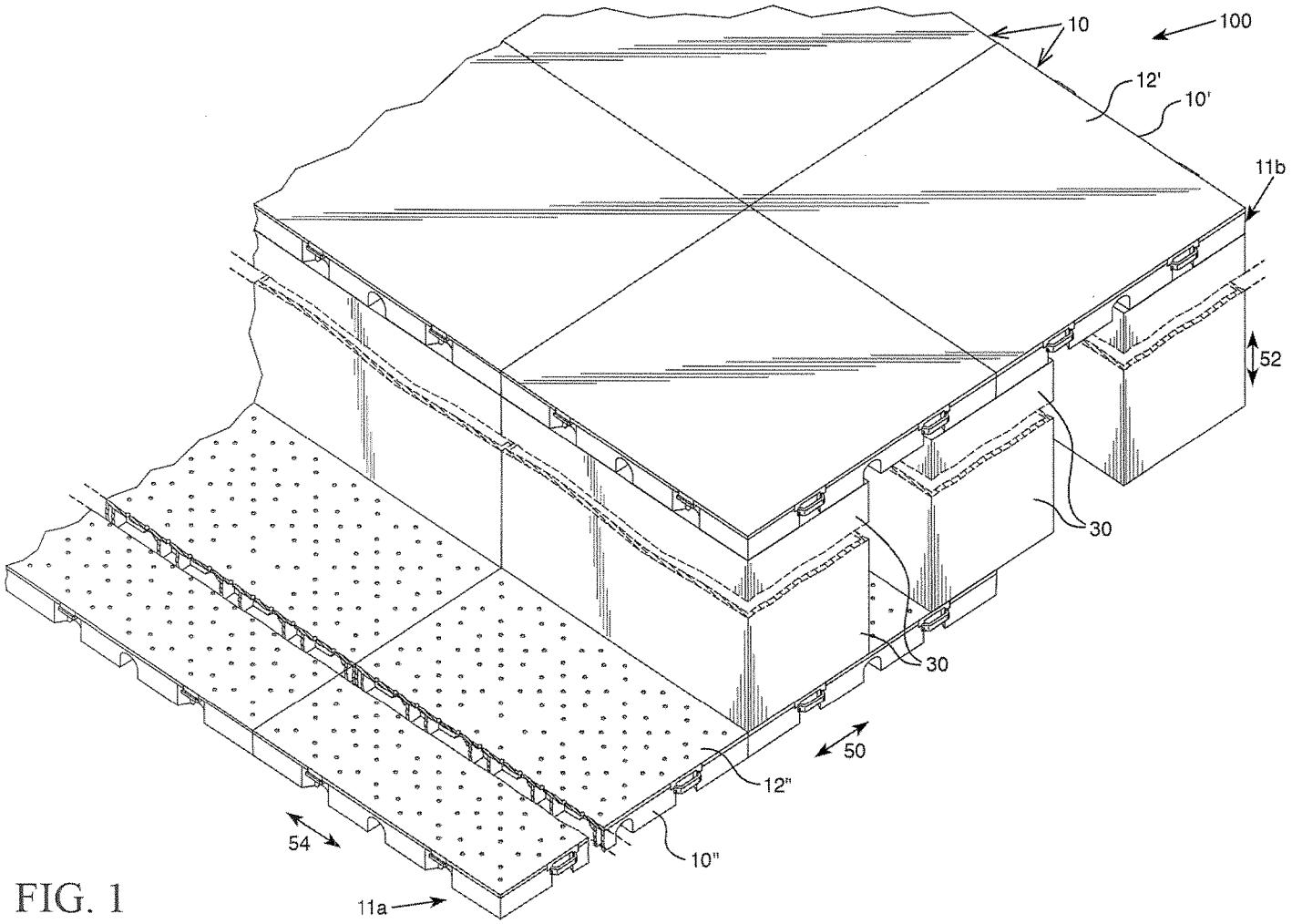
FIG. 1 is a top isometric view of an exemplary embodiment of the elevated flooring system.

As shown in the accompanying drawings, the present invention is directed to an elevated flooring system 100 that can be used to create a modular flooring system along a surface such as the ground, and can also create various raised areas and elevated sections for increased height, such as for a dais, stage, podium, stairs or other structure. To accomplish this, the elevated flooring system 100 includes a plurality of floor modules 10, at least a portion of which collectively form at least one layer 11, and the layers 11 are separated by at least one block 30 supporting and interconnecting various floor modules 10 and layers 11 to create differences in height of various portions of the elevated flooring system 100.

Figure 2:
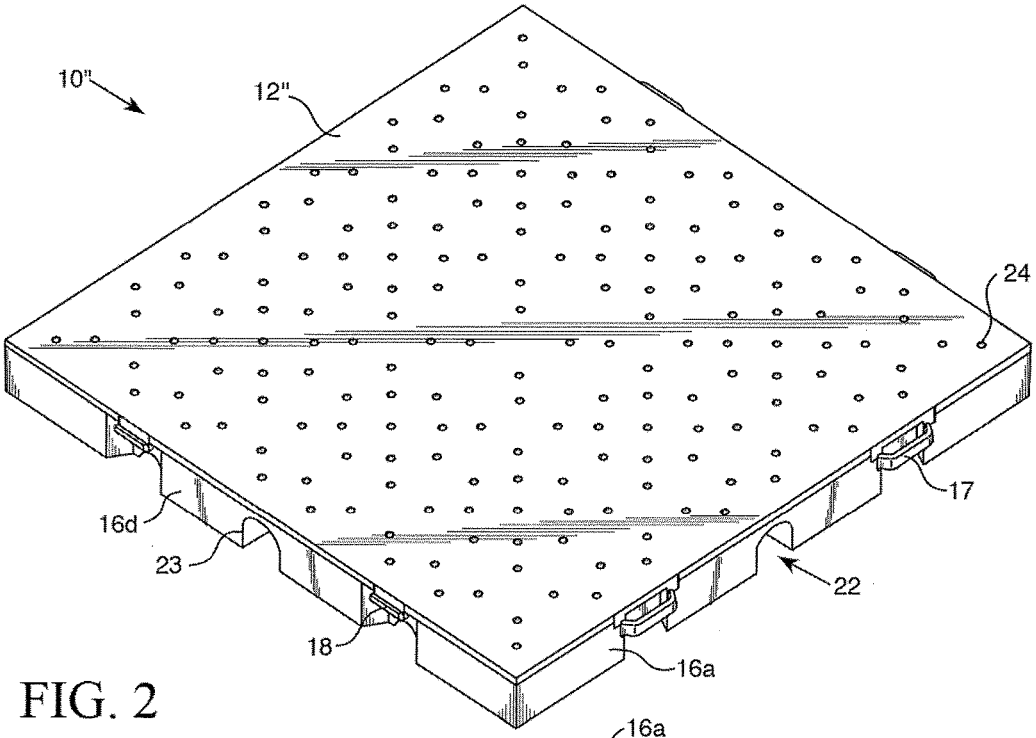
FIG. 2 is a top isometric view of one embodiment of a flooring module used in the elevated flooring system.
Figure 3:
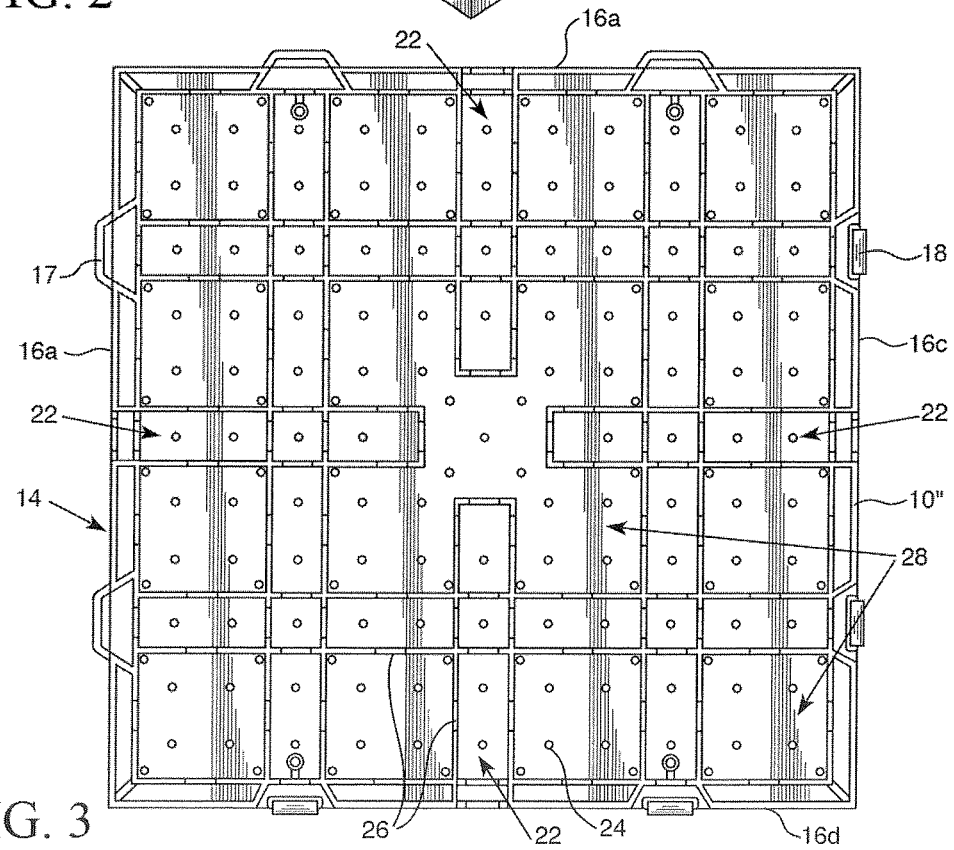
FIG. 3 is a bottom plan view of the flooring module of FIG. 2.

As seen in FIGS. 1-3, the elevated flooring system 100 includes a plurality of floor modules 10. Each floor module 10 may be made of any suitable material for modular flooring, such as but not limited to natural and synthetic plastics, natural and synthetic resins, polymer-based materials such as polypropylene and polyethylene, and other similar materials and combinations thereof, which may also include stabilizers, fillers, plasticizers, colorants, or other additives to enhance physical, chemical and aesthetic characteristics. The floor modules 10 within an elevated flooring system 100 may all be made of the same material or different material from one another, and combinations thereof. Each floor module 10 may be formed by any suitable method according to the material used, such as but not limited to injection molding, compression molding, extrusion, die casting, carving or cutting such as by laser or other tool, and 3D printing. Each floor module 10 includes a first module surface 12, such as shown in FIG. 2. The first module surface 12 is a top surface configured to support pedestrian traffic, equipment, and additional components of the elevated flooring system 100. The first module surface 12 is smooth in that it contains no protrusions or obstructions to movement. In some embodiments, as shown in FIG. 1, some floor modules 10' may have a solid first module surface 12' that is a continuous surface without breaks or obstructions. In some embodiments, the first module surface 12' of certain floor modules 10 may include frictional members such as tread to provide traction and reduce slipping, but may not be so large as to obstruct movement. In other embodiments, as in FIGS. 1 and 2, some floor modules 10" may have a first module surface 12" including a plurality of holes 24 formed therein. Such holes 24 may pass through the first module surface 12" to allow for drainage of fluids and materials therethrough, to prevent pooling of fluids that may cause unsafe conditions on the first module surface 12. The holes 24 may be any size and shape, not necessarily limited to a circular shape, and may be arranged in any pattern or configuration. In at least one embodiment, each hole 24 is configured to receive and retain an interfacing member 40, discussed in greater detail below. The holes 24 may be the same size, shape and configuration as one another, or may be different from one another. Similarly, different floor modules 10" having holes 24 in their respective first module surfaces 12" may have different numbers, patterns, arrangements, sizes, shapes and configurations of holes 24 from one to another.

Regardless of whether it is continuous or includes holes 24, the smooth first module surface 12 may also include a pattern, label, design or other indicia. The indicia may be unique and proprietary, or it may be generic. For instance, in some embodiments, the indicia may resemble wood grain patterns. In other embodiments, the indicia may be a pattern imitating tile, mosaics, laminate, glass, stone, marble or other building or flooring materials. In some embodiments, the indicia may be applied to the exterior of the first module surface 12 after the floor module 10 is formed, such as by heat application or pressing into the material before, during or after curing. In other embodiments, the indicia may be formed in the first module surface 12, such as through a process of in-mold labeling.

Each floor module 10 also includes second module surface 14 opposite the first module surface 12, shown in FIG. 3. The second module surface 14 therefore forms the underside of the floor module 10. The second module surface 14 is open to the surrounding environment, exposing a plurality of module ribs 26 formed in the floor module 10. The module ribs 26 support the first module surface 12 from underneath, providing structural support and rigidity to the floor module 10. The module ribs 26 may be made of the same material as the floor module 10 and may be formed during the formation of the floor module 10, however, in certain embodiments the module ribs 26 may be made of a different material from that of the flooring module 10. In a preferred embodiment, the module ribs 26 are of the same height as the floor module 10, spanning from the underside of the first module surface 12 to the bottom of the floor module 10 which may be placed on the ground, floor, or block(s) 30 as described in greater detail below. For instance, the floor modules 10 and module ribs 26 may have a height in the range of ⅝ inch to 6 inches. However, in other embodiments, at least some of the module ribs 26 have a height that is less than that of the floor module 10. The module ribs 26 may have any thickness suitable for the load capacity and material composition of the floor module 10 in order to support the same. For instance, in at least one embodiment the module ribs 26 have a thickness in the range of 1/16 inch to ½ inch. The various module ribs 26 within the same floor module 10 may have the same height and thickness, or may have different heights and thicknesses from one another. Similarly, the module ribs 26 of one floor module 10 may have the same or different heights and thicknesses from those of another floor module 10 within the elevated flooring system 100.

The module ribs 26 may extend along the perimeter of the floor module 10 and/or may also extend away from the perimeter toward the interior of the floor module 10, such as in the direction of the center of the floor module 10. The module ribs 26 may be linear, curved, curvilinear, or any shape or configuration, and may be positioned parallel to, intersecting, or at an angle to any of the other module ribs 26. Accordingly, various module ribs 26 may collectively define space(s) therebetween, such as module receiving spaces 28. Each module receiving space 28 is dimensioned, shaped and configured to receive a corresponding one of an extension 36 from a block 30 or the body 42 of an interfacing member 40, as described in greater detail below. In at least one embodiment, as shown in FIG. 3, the module ribs 26 may be linear and may collectively form and at least partially define square or rectangular receiving spaces 28 in the second module surface 14.

Figure 9:
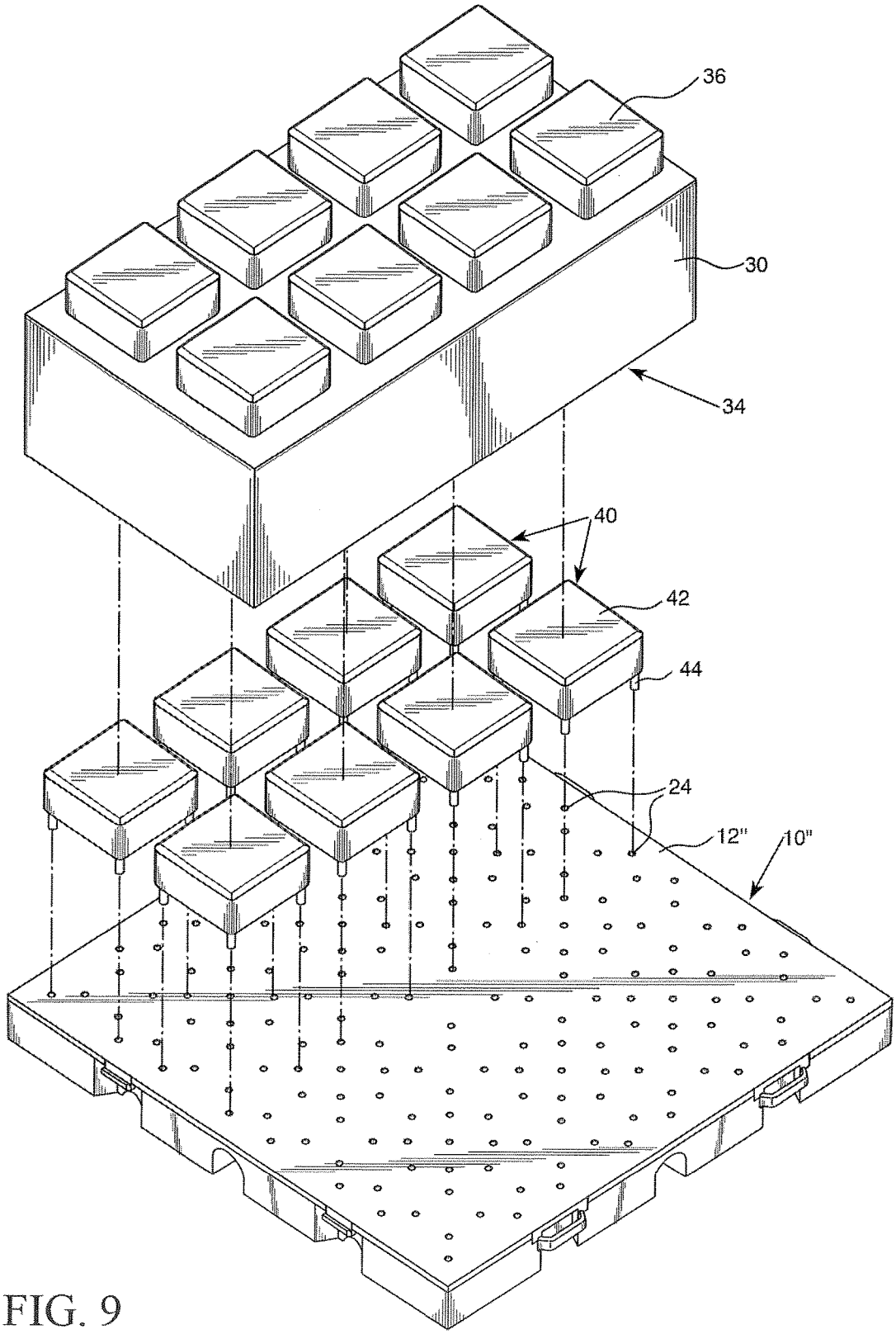
FIG. 9 is a top exploded view of an exemplary floor module, block, and interconnecting interfacing members comprising the elevated flooring system.

The second module surface 14 of the floor module 10 may also include at least one channel 22 formed therein. The channel(s) 22 spans at least a portion of the floor module 10, and in at least one embodiment spans the entire length or width of the floor module 10 along the second module surface 14. Multiple channels 22 may be included in the floor module 10, and may run parallel, perpendicular, or at an angle to other channels 22 in a common floor module 10. For instance, as shown in FIG. 3, channels 22 may run coaxially and perpendicular to one another. The channels 22 may extend through, be formed in and at least partially defined by the module ribs 26 on the second module surface 14 of the floor module 10. As depicted in FIG. 9, the module ribs 26' through which the channel(s) 22 extend may have a smaller height dimension than the remaining module ribs 26 of the floor module 10. The channel(s) 22 are dimensioned to receive cables, cords, wires, and other similar materials as may be beneficial to run through the floor module 10 rather than over it for safety reasons. Examples include, but are not limited to power cords, data cords and auxiliary cables and wires for equipment, gear, electronics, lights, audio-visual equipment such as speakers and microphones, and other devices that may be used in the vicinity of the elevated flooring system 100.

As shown in FIGS. 1-3, each floor module 10 is bounded by at least one perimetric side 16 that extends at least between the first module surface 12 and the second module surface 14. The sides 16 define the height of the floor module 10 in the vertical direction 52. There may be any number of sides 16, but in at least one embodiment the modules 10 include a first side 16*a*, second side 16*b*, third side 16*c* and fourth side 16*d*, such as shown in FIG. 3. The sides 16*a*, 16*b*, 16*c* and 16*d* may be arranged at right angles to the next adjacent side, such that the first and third sides 16*a* and 16*c* are opposite one another, and the second and fourth sides 16*b* and 16*d* are opposite one another. Accordingly, the floor module 10 may have a square or rectangular shape, although other shapes are also contemplated. For instance, in one embodiment the floor module 10 may be round and include a single side 16. In other embodiments the floor module 10 may be irregularly shaped and have any number of sides 16, which may be linear, curved, or curvilinear. The floor modules 10 may also have any dimension. For instance, the floor modules 10 may measure in the range of 6 inches to 14 feet in a first lateral direction 50 (width), 6 inches to 14 feet in a second lateral direction 54 (length), and ⅝ inch to 6 inches in the vertical direction 52 (height). In at least one embodiment the floor modules 10 may measure 12 inches× 12 inches×1 inch. In other embodiments, the floor modules 10 may measure 18 inches×24 inches×1 inch. These are a few illustrative examples are not intended to be limiting.

Figure 7:
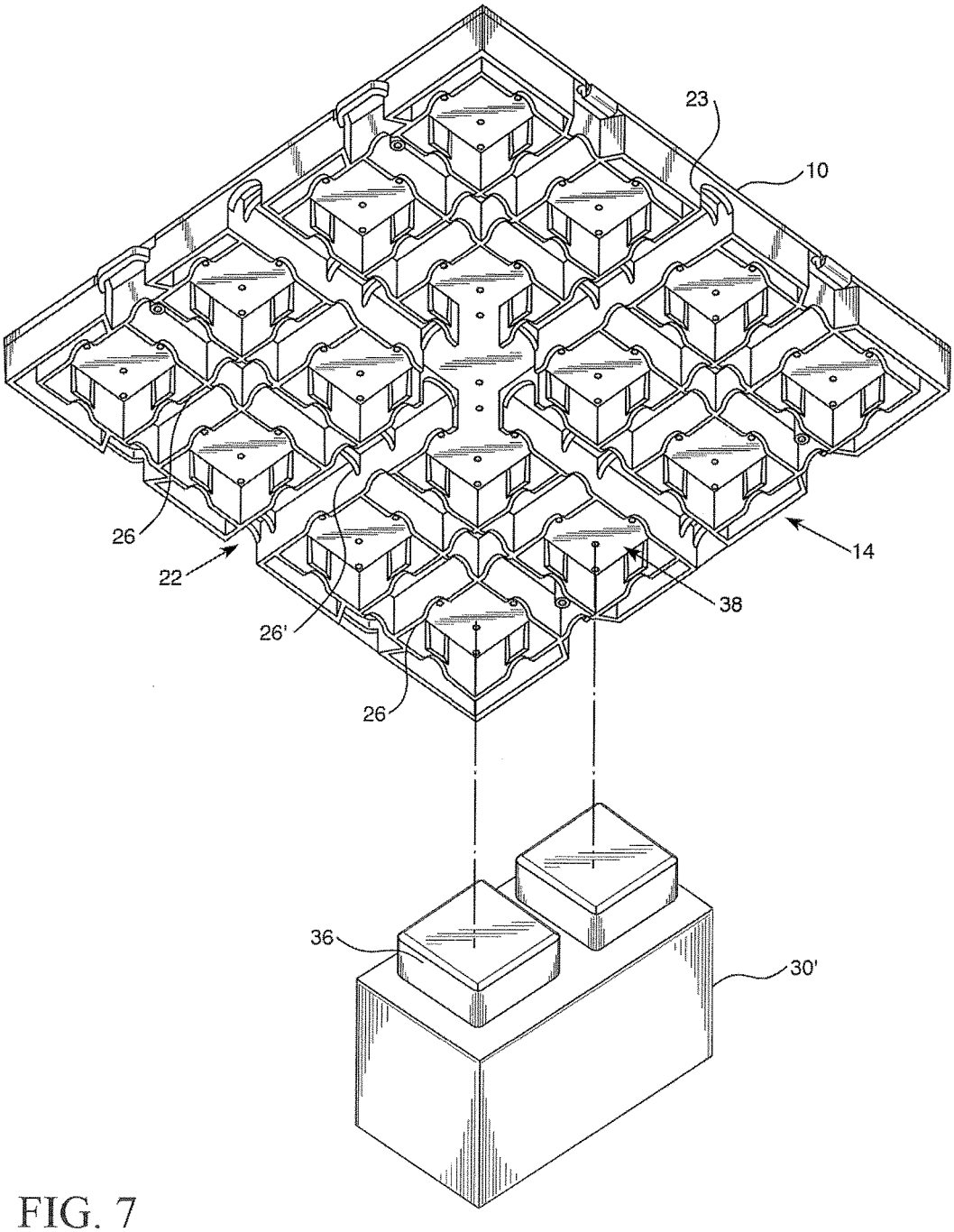
FIG. 7 is an exploded view showing the alignment exemplary block with the second module surface of a floor module.

Each side 16 may include an aperture 23 aligning with and providing access to a channel 22 of the second module surface 14. The aperture 23 may therefore be similarly sized and shaped as the channel 22, or may be larger or smaller than the corresponding channel 22 so long as access is still provided. In at least one embodiment, the aperture 23 is the same size, shape and configuration as a cross-section of the channel 22, such that the top of the aperture 23 has the same position and shape as the module ribs 26' forming the channel 22 on the second module surface 14, as depicted in FIG. 7. However, in other embodiments aperture 23 may have a different shape or size than the module ribs 26' corresponding to the channel 22.

Figure 4:
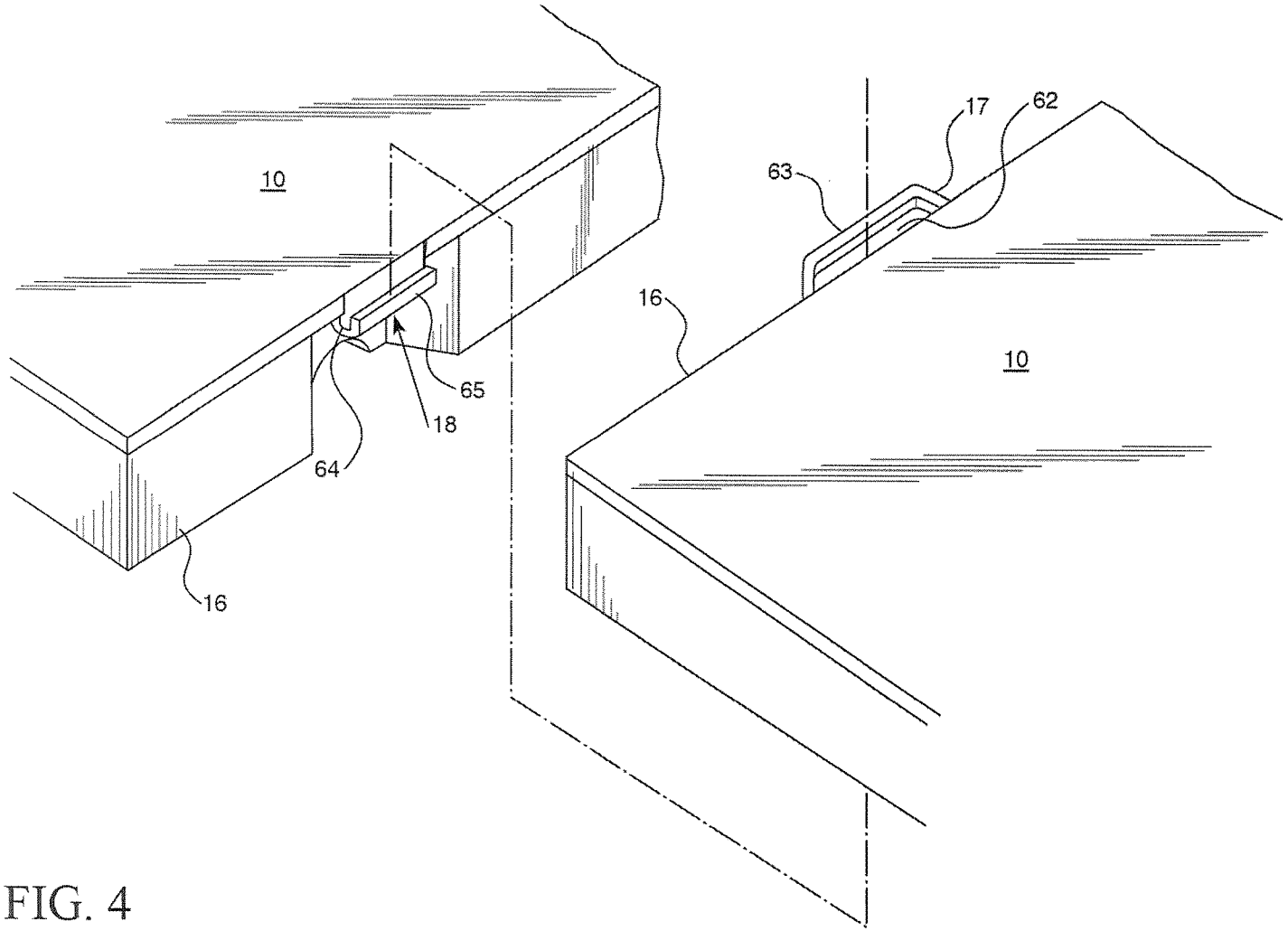
FIG. 4 is an exploded detail view showing a first connector of a first floor module connecting to a second connector of an adjacent floor module.

Each side 16 may also include at least one connector 17, 18 dimensioned to engage a corresponding connector on a side 16 of an adjacent floor module 10 when joining floor modules 10 together. For instance, as depicted in FIGS. 2-4, at least one side 16 includes at least one first connector 17, and at least one different side 16 includes at least one second connector 18. Each first connector 17 extends from the edge of the side 16 away from the floor module 10, and may form a loop structure defining an opening 62 between the distal portion 63 of the first connector 17 and the side 16 of the floor module 10. This opening 62 may be dimensioned to receive and/or retain a portion of a second connector 18 therein, as described below. The first connector 17 may be configured in any suitable shape, such as curved, circular, semi-circular, oblong, linear, angular, triangular, square, rectangular, trapezoidal, and any combination thereof. In at least one embodiment, as depicted in FIG. 4, the first connector 17 may be shaped as a trapezoidal loop extending away from the side 16 of the floor module 10 and having a flat terminal edge. The first connector 17 may be at least a portion of the height of the floor module 10, such as less than half the height of the floor module 10. In other embodiments, the first connector 17 may span the entire height of the side 16, and therefore of the floor module 10.

At least one side 16 also includes at least one second connector 18. The second connector 18 also extends from the side 16 and away from the flooring module 10. Rather than forming a loop, the second connector 18 includes an extension 64 and a terminal portion 65 having a tab, lip or other similar feature. The extension 64 supports the terminal portion 65 at a predetermined distance from the side 16 of the floor module 10, and may itself be rounded or planar. The terminal portion 65 is correspondingly dimensioned to the opening 62 of the first connector 17 of another floor module 10, and may be planar, curved or have another type of shape. When joining adjacent floor modules 10 together, as depicted in FIG. 4, the terminal portion 65 of a second connector 18 is inserted into the opening 62 formed by a corresponding first connector 17 of an adjacent floor module 10. The opening 62 formed by the first connector 17 is dimensioned to receive the terminal portion 65 of the second connector 18. The first connector 17 may further be dimensioned to retain the terminal portion 65 of the second connector 18, such as by a frictional fit, snap fit, or other suitable connection. The terminal portion 65 of the second connector 18 may enter the opening 62 of the first connector 17 from either above or below the first connector 17 depending on the orientation of the terminal portion 65. The extension 64 of the second connector 18 may be dimensioned to receive the distal portion 63 of the first connector 17 when the two connectors 17, 18 are joined together. Accordingly, the first and second connectors 17, 18 are correspondingly dimensioned, and in some embodiments, may be matingly connected.

In at least one preferred embodiment, each side 16 may include multiple connectors of the same type. In other embodiments each side 16 may include multiple connectors of different types. For instance, one side 16 may include a plurality of first connectors 17, and a different side 16 may include a plurality of second connectors 18. In some embodiments, adjacent sides 16 may have the same type of connector 17, 18. For instance, in at least one embodiment as shown in FIG. 3, the first and second sides 16*a*, 16*b* each have at least one first connector 17, and the third and fourth sides 16*c*, 16*d* each have at least one second connector 18. In other embodiments, opposite sides 16 may have the same type of connector 18, such as the first and third sides 16*a*, 16*c* having first connector 17, and the second and fourth sides 16*b*, 16*d* having second connectors 18. In still other embodiments, each side 16 may include at least one first connector 17 and at least one second connector 18. Any number and combination of connectors 17, 18 may be present on any side 16 to achieve connection of adjacent floor modules 10.

Multiple floor modules 10 may be arranged adjacent to one another and connected to one another in a first lateral direction 50 through the first and second connectors 17, 18, as described above, to form a layer 11. A layer 11 may form a floor surface of the system 100 which can support people, animals, equipment, furniture, and other components of the floor system 100. A single layer 11 may include any number of floor modules 10 in the first lateral direction 50 or the second lateral direction 54, as shown in FIG. 1. Accordingly, each layer 11 is expandable in the lateral directions 50, 54. The boundaries of each layer 11 may be irregular, such that the layer 11 overall does not have to follow a uniform structure or shape. Further, a single layer 11 may include any combination of types of floor modules 10, 10', 10", such that different areas of a layer 11 may have a solid surface while other areas may have holes for drainage purposes. The system 100 may include multiple layers 11 of floor modules 10, where each layer 11 is spaced apart in the vertical direction 52, as seen in FIG. 1. As used herein, the lateral directions 50, 54 are parallel to an underlying support surface, such as the ground or floor of a building or space, and may be substantially planar. The vertical direction 52 is perpendicular to the underlying support surface.

Figure 5:
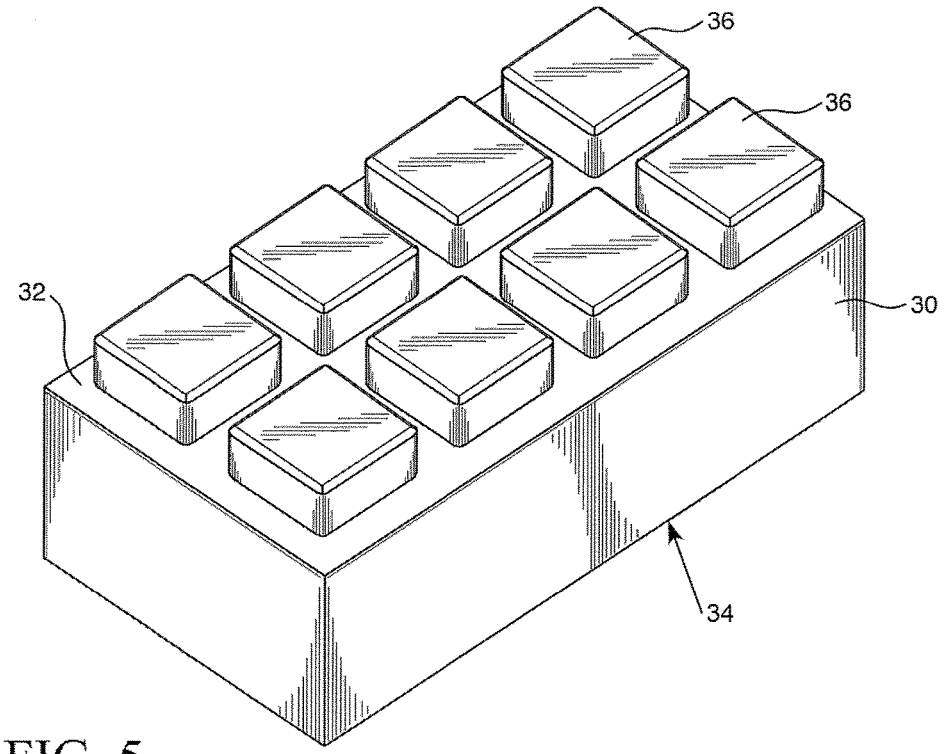
FIG. 5 is a top isometric view of one embodiment of a block used in the elevated flooring system.
Figure 6:
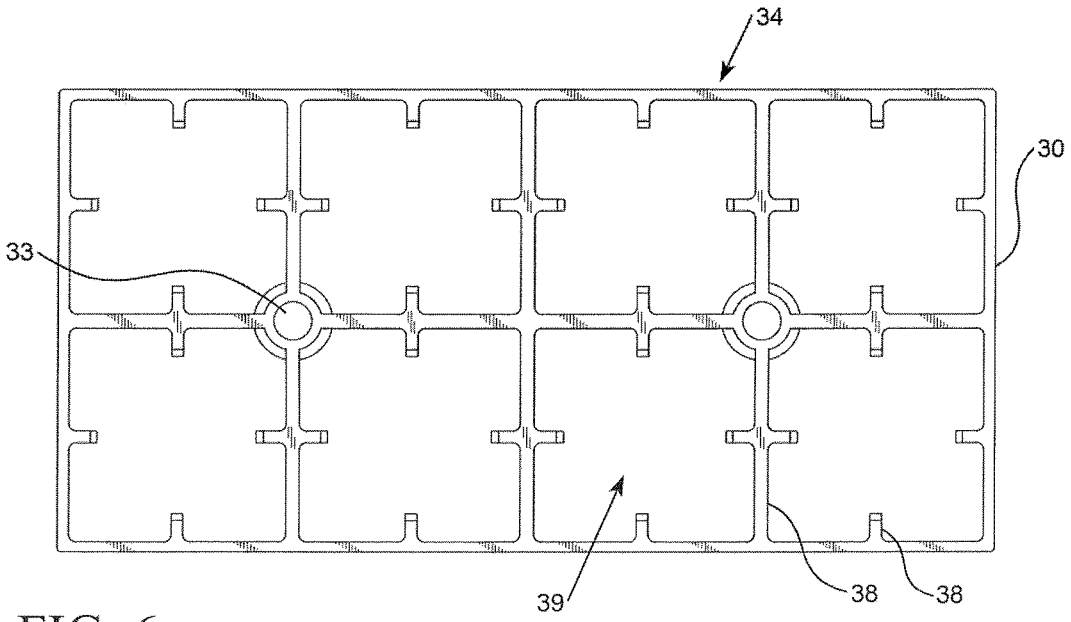
FIG. 6 is a bottom plan view of the block of FIG. 5.

Referring to FIGS. 1, 5 and 6, the elevated flooring system 100 further includes at least one block 30 dimensioned to connect with at least one floor module 10, and may connect layers 11 of the system 100. Block(s) 30 may be made of the same material as the floor modules 10, such as but not limited to natural and synthetic plastics, natural and synthetic resins, polymer-based materials such as polypropylene and polyethylene, and other similar materials and combinations thereof, which may also include stabilizers, fillers, plasticizers, colorants, or other additives. Various blocks 30 used within the same elevated flooring system 100 may be made of the same material as each other, or of different materials from one another. Similarly, the blocks 30 may be the same color or different colors from one another, and may be the same or different colors from the floor modules 10. The block(s) 30 may be made by any suitable method according to the material used, such as but not limited to injection molding, compression molding, extrusion, die casting, carving or cutting such as by laser or other tool, and 3D printing.

Each block 30 includes a first block surface 31, which may be considered a top surface, and an opposite second block surface 34 which may be considered a bottom surface. The height of the block 30 defines the distance between the first and second block surfaces 32, 34. The first block surface 32 may preferably be solid, though in some embodiments it may include a bore(s) 33 extending through the block 30 from the first block surface 32 to the second block surface 34. The bore(s) 33 are sized, shaped and dimensioned to permit the passage of cables, wires, or other materials therethrough, which may be useful when running between layers 11 of the elevated flooring system 100. They may also be dimensioned to permit the passage of pins, rods or other similar rigid elongate material as may provide additional structural support to the elevated flooring system 100. The bore 33 may be of any shape, size and dimension, such as but not limited to circular, oval, square, rectangular, triangular, oblong, and irregular.

Each block 30 also includes at least one extension 36 protruding from the first block surface 32. Each extension 36 may be sized, shaped and configured to correspond with, and fit at least partially within, a module receiving space 28 of a floor module 10 as discussed above and shown in FIG. 7. Accordingly, the extensions 36 may be square, rectangular, circular, ovoid, spherical, irregular or other shaped, corresponding to the module receiving space 28 defined by the module ribs 26. In at least one embodiment, the extensions 36 are square in shape and correspond to square-shaped module receiving spaces 28 in a floor module 10. The extensions 36 may be the same or different shapes from one another on the same block 30, and may be the same or different shapes from extensions 36 of another block 30. The height of the extensions 36 may preferably correspond to the height of the module ribs 26 forming the boundaries of the corresponding module receiving space 28. In some embodiments, this may be the same height of the floor module 10. In other embodiments, the extensions 36 may be at least the same height or greater than that of the module ribs 26 forming the boundaries of the corresponding module receiving space 28. This may be useful in embodiments where the module ribs 26 forming the module receiving space 28 are less than the full height of the floor module 10. The extensions 36 may preferably be a fraction of the height of the remainder of the block 30, as in FIG. 5. In other embodiments, however, the extensions 36 may be the same height as, or greater than, the remainder of the block 30.

Further, each block 30 may include any number of extensions 36. For instance, a block 30 may include from one to twelve extensions 36, or more. In at least the embodiment shown in FIG. 5, the block 30 may include six extensions 36. In other embodiments, such as shown in FIG. 7, the block 30' may include two extensions 36. The various extensions 36 may be arranged or configured spaced apart from one another on the first block surface 32 by a predetermined distance, which may be uniform between the extensions 36. The extensions 36 may be arranged in a grid, as shown in FIG. 5, or may be arranged linearly as in FIG. 7. In still other embodiments, the extensions 36 may be arranged in any configuration with respect to one another. Accordingly, the size and dimensions of the block 30 may vary depending on the number and arrangement of extensions 36 included. In at least one embodiment as in FIGS. 5 and 7, the blocks 30, 30' may be rectangular or square in shape. In other embodiments, the block 30" may be circular as in FIG. 10. In still other embodiments, the blocks 30 may be oblong or irregularly shaped. Further, the blocks 30 may be the same length and/or width as the floor modules 10. In other embodiments, the blocks 30 may have dimensions greater than or less than the length and/or width of the floor modules 10. In at least one embodiment, the blocks 30 have a greater height dimension than the floor modules 10, though in other embodiments the blocks 30 may be the same height as the floor modules 10 or smaller.

Figure 8:
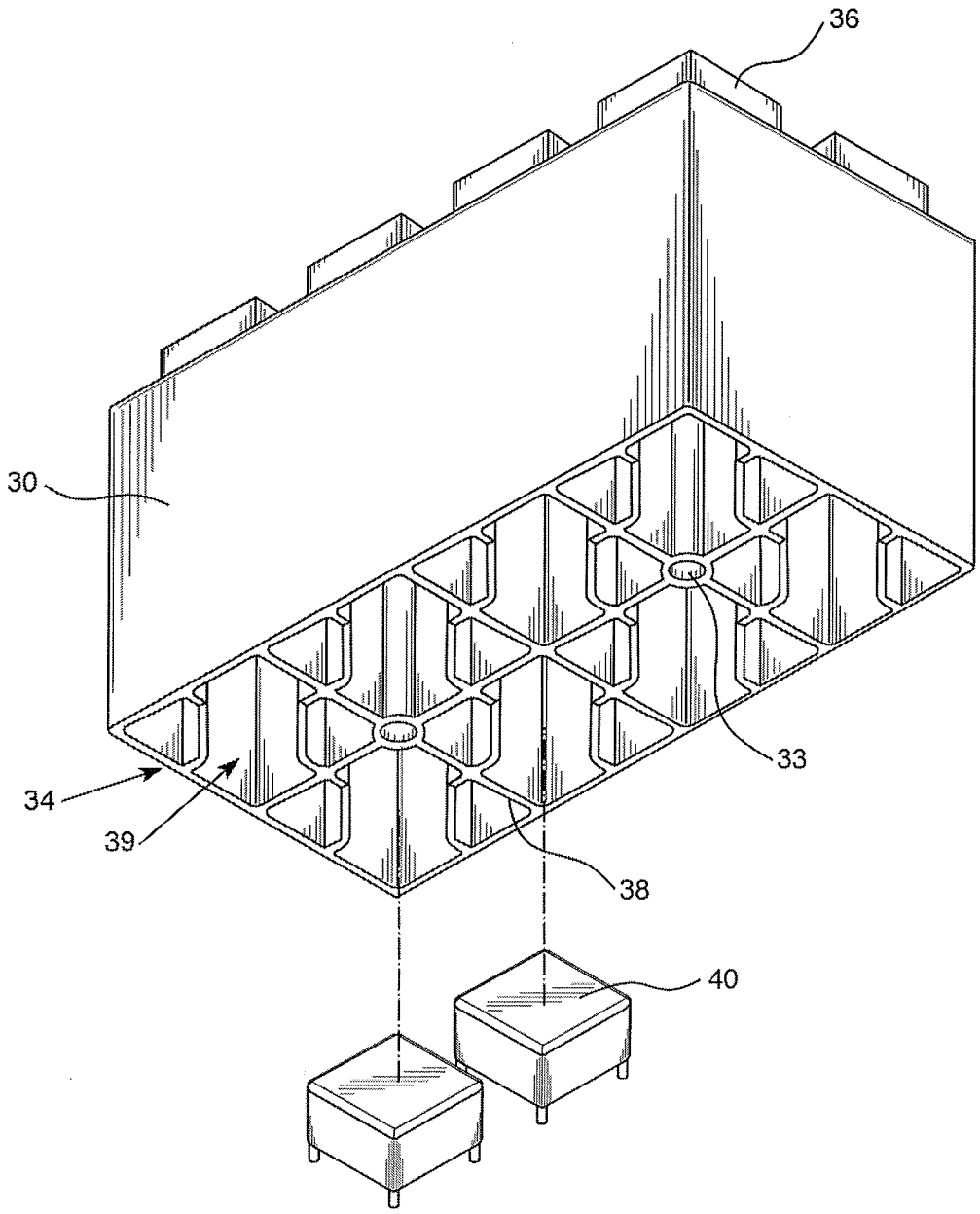
FIG. 8 is an exploded view showing the alignment of interfacing members with a second block surface of a block.

Each block 30 includes a second block surface 34 opposite the first block surface 32, such as shown in FIGS. 6 and 8. The second block surface 34 therefore forms the underside or bottom side of the block 30. In a preferred embodiment, the second block surface 34 is open, exposing a plurality of block ribs 38 formed in the block. The block ribs 38 support the first block surface 32 from underneath, providing structural support and rigidity to the block 30. The block ribs 38 may be made of the same material as the block 30 and may be formed during the formation of the block 30, however, in certain embodiments the block ribs 38 may be made of a different material from that of the block 30. In a preferred embodiment, the block ribs 38 have the same height as the block 30, spanning from the underside of the first block surface 32 to the bottom of the block 30 which may be placed on the ground, floor, or floor module(s) 10 as described in greater detail below. For instance, the blocks 30 and block ribs 38 may have a height in the range of ½ inch to 36 inches. However, in other embodiments, at least some of the block ribs 38 have a height that is less than that of the block 30. The block ribs 38 may have any thickness suitable for the load capacity and material composition of the block 30 in order to support the same. For instance, in at least one embodiment the block ribs 38 have a thickness in the range of 1/16 inch to ½ inch. The various block ribs 38 within the same block 30 may have a uniform height and thickness, or may have different heights and thicknesses from one another. Similarly, the block ribs 38 of one block 30 may have the same or different heights and thicknesses from those of another block 30 within the elevated flooring system 100.

The block ribs 38 may extend along the perimeter of the block 30 and may also extend away from the perimeter toward the interior of the block 30, such as in the direction of the center of the block 30. The block ribs 38 may be linear, curved, curvilinear, or any shape or configuration, and may be positioned parallel to, intersecting, or at an angle to any of the other block ribs 38. Accordingly, various block ribs 38 may collectively define space(s) therebetween, such as block receiving spaces 39. Each block receiving space 39 is dimensioned, shaped and configured to receive a corresponding body 42 of an interfacing member 40 or one of an extension 36 from another block 30, as described in greater detail below. The block receiving space 39 may further be dimensioned to retain the body 42 of an interfacing member 40 or one of an extension 36 from another block 30, such as by a frictional fit, snap fit, or other suitable connection. In at least one embodiment, as shown in FIG. 8, the block ribs 38 may be linear and may collectively form and at least partially define square or rectangular block receiving spaces 39 in the second block surface 34.

With reference now to FIGS. 8 and 9, the elevated flooring system 100 further includes at least one interfacing member 40 to facilitate the connection of a block(s) 30 with the first module surface 12 of a floor module 10. Each interfacing member 40 includes a body 42 and at least one leg 44 extending from the body 42. The interfacing members 40 may be made of the same material as the floor modules 10 or blocks 30, such as but not limited to natural and synthetic plastics, natural and synthetic resins, polymer-based materials such as polypropylene and polyethylene, and other similar materials and combinations thereof, which may also include stabilizers, fillers, plasticizers, colorants, or other additives. Various interfacing members 40 used within the same elevated flooring system 100 may be made of the same material as each other, or of different materials from one another. Similarly, the interfacing members 40 may be the same color or different colors from one another, and may be the same or different colors from the floor modules 10 and/or blocks 30. The interfacing members 40 may be made by any suitable method according to the material used, such as but not limited to injection molding, compression molding, extrusion, die casting, carving or cutting such as by laser or other tool, and 3D printing. Preferably, the body 42 and leg(s) 44 of a single interfacing member 40 may be made of the same material, and may be of a unitary construction. In other embodiments, however, the legs 44 may be added to the body 42, such as by adhesive, molding, co-extrusion, frictional connection such as screw action, or the like.

The body 42 is sized, shaped and dimensioned to correspond to, and fit at least partially within, a block receiving space 39 accessed through the second block surface 34, as shown in FIG. 8. In at least one embodiment, the body 42 may be square or rectangular in shape, although in other embodiments the body 42 may be circular, spherical, ovoid, oblong, angular, or irregularly shaped, as but a few non-limiting examples. Accordingly, a block 30 may be stacked on top of at least one interfacing member 40. The height of the body 42 may therefore be at least the height of the block receiving space 39, and may be the height of the block 30. In certain embodiments, the body 42 of an interfacing member 40 may also be dimensioned to correspond to, and fit at least partially within, a module receiving space 28 of a floor module 10. The body 42 may be solid, or in some embodiments may define a cavity therein.

The legs 44 of the interfacing member 40 may have any shape and dimension, and the legs 44 of a common interfacing member 40 may have a uniform shape and dimension as one another. For instance, in at least one embodiment the legs 44 may be pegs, pins, or other type projections that extend from the body 42 of the interfacing member 40, and may be cylindrical or rectangular. In at least one embodiment as shown in FIG. 9, the legs 44 may be cylindrical and dimensioned to fit within corresponding ones of holes 24 on the first module surface 12 of a floor module 10". Indeed, the pattern of holes 24 on the first module surface 12 of a floor module 10" may be designed to allow for any number of configurations of interfacing members 40 to be selectively attached thereto as a result of a frictional fit between legs 44 within the holes 24. In other embodiments, the legs 44 of interfacing members 40 and the holes 24 of a floor module 10" may be matingly fit, such as with tongue and groove features.

The elevated flooring system 100 is fully modular and so can be assembled in any number of ways, with the various components being selectively attachable to other components. For instance, as shown in FIG. 9, a floor module 10 may act as the base to which a plurality of interfacing members 40 may be attached, such as by insertion of the legs 44 into the holes 24 of the floor module 10". The bodies 42 of the interfacing members 40 then extend above the first module surface 12 and can be inserted to the block receiving spaces 39 of a block 30. Accordingly, interfacing members 40 may be placed on top of floor modules 10, and blocks 30 may be placed on top of (and surrounding) the interfacing members 40. Blocks 30 may also be stacked on other blocks 30 to achieve greater elevation. Similarly, floor modules 10 may be further placed on top of blocks 30, such as by the extensions 36 of the block 30 being received within module receiving spaces 28 of the floor module 10, as in FIG. 7. In such a manner, the elevated flooring system 100 may be assembled with any number of floor modules 10 and any number of blocks 30 to cover any amount of space along first and second lateral directions 50, 54 and reach any height in the vertical direction 50, as shown in FIG. 1. Further, any number of blocks 30 may be stacked on the interfacing members 40 or other blocks 30 to create any amount of distance between layers 11 of the elevated flooring system 100. It should also be appreciated that either blocks 30 or floor modules 10 may be placed on the ground, floor, or other underlying structure on which the elevated flooring system 100 is to be assembled to form the base of the elevated flooring system 100.

Figure 10:
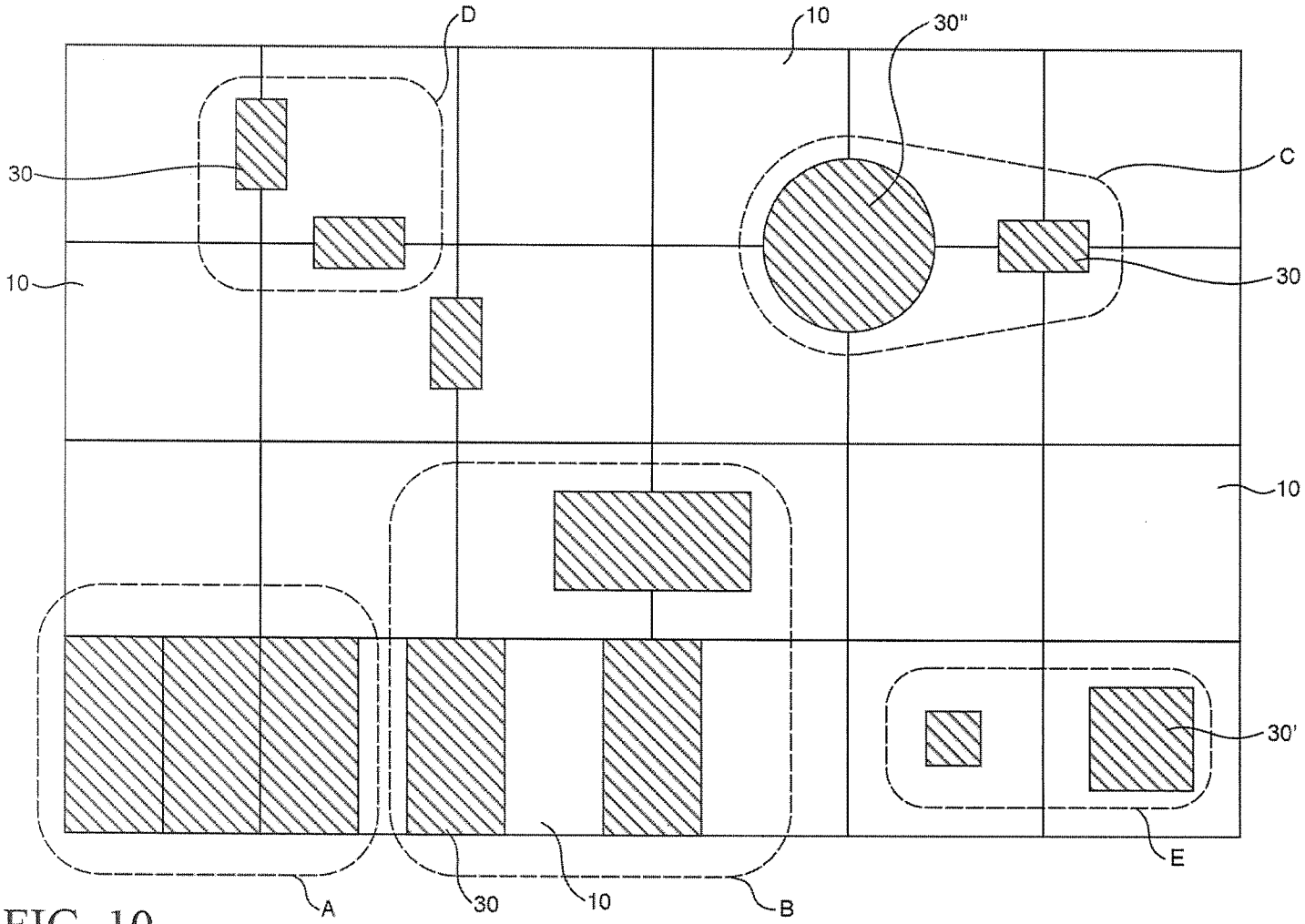
FIG. 10 is a schematic diagram of the elevated flooring system, showing various illustrative ways in which the blocks may connect to the flooring modules.

Further, although layers 11 are formed by joining adjacent floor modules 10 through the first and second connectors 17, 18, the floor modules 10 may further be locked in place by the placement of blocks 30 above or below. A block 30 may be placed aligning at least a portion of the joining floor module 10, or it may be placed to overlap the joining floor module(s) 10. FIG. 10 demonstrates various exemplary placement positions of blocks 30 relative to floor modules 10. For instance, a block 30 may fully align with a corresponding floor module 10 as in group A. A block 30 may also be positioned to overlap two adjacent floor modules 10, as in group B. Blocks 30 may also be placed at the vertices where multiple floor modules 10 come together, as in group C. Blocks 30 may overlap adjacent floor modules 10 along at least a portion of a shared side 16, as in group D. Finally, a floor module 10 may be only partially supported by a block 30, as in group E. These are but a few illustrative examples and are not intended to be limiting.

Since many modifications, variations and changes in detail can be made to the described preferred embodiments, it is intended that all matters in the foregoing description and shown in the accompanying drawings be interpreted as illustrative and not in a limiting sense. Thus, the scope of the invention should be determined by the appended claims and their legal equivalents. Now that the invention has been described.

What is claimed is:

1. A flooring system, comprising:

at least one block having a first block surface, an opposite second block surface, and at least one extension protruding from said first block surface by a predetermined height;

a plurality of floor modules each having a smooth first module surface, an opposite second module surface, at least one perimetric side extending between said first and second module surfaces, and at least one connector extending outwardly from said at least one perimetric side, each of said at least one connector shaped to engage a corresponding connector of a different one of said plurality of floor modules;

at least one of said plurality of floor modules further including a plurality of holes formed in said first module surface and dimensioned to receive an interfacing member;

said second module surface of each of said plurality of floor modules including a plurality of module ribs configured to collectively define at least one module receiving space dimensioned to receive said at least one extension of said at least one block; and said at least one block and said plurality of floor modules being stackable in a vertical direction to create an elevated flooring system.

2. The flooring system as recited in claim 1, further comprising at least one interfacing member having a body and at least one leg extending from said body, said at least one leg dimensioned to be inserted and received in a corresponding one of said plurality of holes of said first module surface.

3. The flooring system as recited in claim 2, wherein said at least one interfacing member is selectively attachable to said first module surface of said flooring module.

4. The flooring system as recited in claim 2, wherein said plurality of holes are collectively configured to accommodate various placements of said at least one interfacing member on said first module surface.

5. The flooring system as recited in claim 2, wherein said at least one block having a plurality of block ribs formed in said second block surface and configured to collectively define at least one block receiving space dimensioned to receive at least a portion of said body of said at least one interfacing member.

6. The flooring system as recited in claim 1, wherein at least one of said plurality of floor modules are positionable on a supporting surface.

7. The flooring system as recited in claim 1, wherein said at least one block is positionable on a supporting surface.

8. The flooring system as recited in claim 1, further comprising at least one layer, each layer formed of different ones of said plurality of floor modules laterally connected to adjacent ones of said plurality of floor modules, said at least one connector of each of said plurality of floor modules configured to engage said at least one connector of an adjacent one of said plurality of floor modules.

9. The flooring system as recited in claim 8, wherein said flooring system includes multiple layers spaced apart in the vertical direction by said at least one block.

10. The flooring system as recited in claim 1, further comprising a plurality of blocks each having a plurality of block ribs integrally formed in said second block surface and configured to collectively define at least one block receiving space dimensioned to receive at least a portion of said at least one extension of a different one of said plurality of blocks.

11. The flooring system as recited in claim 1, wherein said connector is one of a first connector and a second connector, wherein said first connector having a loop structure and defining an opening between a distal portion of said loop structure and said at least one side of said floor module, said second connector having an extension of a predetermined length and a terminal portion protruding from said extension, wherein said opening of said first connector is dimensioned to receive and retain said terminal portion of said second connector.

12. The flooring system as recited in claim 11, wherein at least a part of said distal portion of said first connector includes a planar configuration.

13. The flooring system as recited in claim 11, wherein each of said plurality of floor modules includes at least one first connector and at least one second connector.

14. The flooring system as recited in claim 13, wherein each of said plurality of floor modules includes a plurality of perimetric sides, each of said sides having at least one of said first and second connectors.

15. The flooring system as recited in claim 14, wherein opposing sides of one of said floor modules have different ones of said first and second connectors.

16. The flooring system as recited in claim 1, wherein said first module surface of at least one of said plurality of floor modules is continuous.

17. The flooring system as recited in claim 1, wherein said first module surface includes at least one indicia.

18. The flooring system as recited in claim 17, wherein said at least one indicia is formed in said first module surface by in-mold labeling.

19. The flooring system as recited in claim 1, wherein each of said plurality of floor modules includes at least one channel extending through said second module surface and dimensioned to receive at least one cord.

20. The flooring system as recited in claim 1, wherein said at least one block further comprising at least one bore extending through said block and said first and second block surfaces.

* * * * *